US006659064B1

(12) United States Patent
Massmann et al.

(10) Patent No.: US 6,659,064 B1
(45) Date of Patent: Dec. 9, 2003

(54) COMPACT FOUR-STROKE COMBUSTION ENGINE, ESPECIALLY FOR THE USE IN A PORTABLE WORKING DEVICE

(75) Inventors: Rainer Massmann, Hamburg (DE); Bernhard Auler, Hamburg (DE); Wolf Burger, Böblingen (DE); Eberhard Witzgall, Illingen (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 10/110,926

(22) PCT Filed: Oct. 10, 2000

(86) PCT No.: PCT/EP00/09939

§ 371 (c)(1),
(2), (4) Date: Apr. 17, 2002

(87) PCT Pub. No.: WO01/29379

PCT Pub. Date: Apr. 26, 2001

(30) Foreign Application Priority Data

Oct. 20, 1999 (DE) ..... 299 18 516

(51) Int. Cl.[7] ..... F01M 1/00
(52) U.S. Cl. ..... 123/196 R; 123/317
(58) Field of Search ..... 123/196 R, 317, 123/80 BB

(56) References Cited

U.S. PATENT DOCUMENTS 5,657,724 A * 8/1997 Brown et al. ..... 123/73 R
5,660,155 A 8/1997 Taue et al.

FOREIGN PATENT DOCUMENTS

DE 3438031 C1 4/1986

* cited by examiner

*Primary Examiner*—Tony M. Argenbright
*Assistant Examiner*—Katrina B. Harris
(74) *Attorney, Agent, or Firm*—McCormick, Paulding & Huber LLP

(57) ABSTRACT

In order to create a compact four-cycle internal combustion engine with mixture lubrication comprising a cylinder which is closed on top by a cylinder head and which changes below into a crankcase, in the cylinder a piston moving up and down, in the cylinder head an intake port with an admission valve and an exhaust conduit with an exhaust valve, a carburetor for forming an oil-fuel-air mixture lubricating the engine, as well as means by which a mixture is transported within each engine cycle from the carburetor into the crank chamber closed by the crankcase and from the crank chamber into the intake port, engine which is constructed in a simple way and which is characterized by a good charging behavior, it is proposed that the carburetor is connected outside the crank chamber with the intake port.

6 Claims, 2 Drawing Sheets

COMPACT FOUR-STROKE COMBUSTION ENGINE, ESPECIALLY FOR THE USE IN A PORTABLE WORKING DEVICE

FIELD OF THE INVENTION

This invention relates to the field of the internal combustion engines.

BACKGROUND OF THE INVENTION

The prior art is a four-cycle engine with oil lubrication, the oil being separately stored from the fuel. The oil is purposefully delivered to the corresponding lubrication points, or it comes from an oil sump as an oil-air mixture (oil mist) to the lubrication points.

The lubrication of a four-cycle internal combustion engine with a fuel-oil-air mixture, similar to the lubrication of two-cycle engines, is also known. The mixture is guided by the carburetor into the crank chamber. A one-way valve avoids the flowing back of the mixture into the carburetor. The mixture arrives over a tubular duct directly into the cylinder head or into a compression chamber. A further one-way valve avoids then the flowing back of the mixture into the crank chamber (see for example the printed document EP-A1-0 631040).

In the known mixture lubrication of the four-cycle internal combustion engine, the whole mixture is guided through the crank chamber to the intake port. This does not only cause an undesired increased flow resistance but also makes necessary the complicated and expensive installation of different valves at different points. A further disadvantage is that the whole mixture is heated through the crank chamber and that the filling of the cylinder is thus reduced.

SUMMARY OF THE INVENTION

The aim of the invention is thus to create a four-cycle internal combustion engine with mixture lubrication which is simply structured for a lubrication which is simultaneously independent of the position and which has a favourable behaviour with respect to the mixture charge.

The aim is achieved by the characteristics of the present invention, taken as a whole. The core of the invention consists in guiding only one part of the mixture for lubrication through the crank chamber, while the other part directly arrives from the carburetor through the intake port into the combustion chamber.

A first preferred embodiment of the engine according to the invention is characterized in that the carburetor is directly connected with the intake port and that the means comprise an overflow duct which leads from the intake port to an overflow opening on the crankcase and, controlled by valve means, connects the intake port with the crank chamber. With this arrangement, a very efficient filling of the combustion space with a mixture can be achieved because of the short paths between the carburetor and the intake port.

A second alternative embodiment is characterized in that the means comprise an overflow duct which leads from the intake port to an overflow opening on the crankcase and, controlled by valve means, connects the intake port with the crank chamber and that the carburetor is connected with the overflow duct or the overflow opening by the valve means. This arrangement makes possible in particular the control of the whole mixture flow through the valve means.

Another preferred embodiment of the engine according to the invention is characterized in that the valve means comprise a rotary disk valve. Such a rotary disk valve makes possible a particularly precisely controlled charge of the mixture part flowing by the crank chamber.

A preferred further development of this embodiment is characterized in that the rotary disk valve is placed in the crankcase at the overflow opening and periodically opens and closes this opening and that the rotary disk valve is driven by a camshaft which actuates the admission and exhaust valves over taper push rods and which is in particular integrated into the camshaft, A space saving arrangement and a simplified drive of the rotary disk valve is thus made possible.

BRIEF DESCRIPTION OF THE DRAWINGS

The invention will be explained in detail below with reference to embodiments which are represented in the drawings.

DETAILED DESCRIPTION OF THE PREFERRED EMBODIMENT

Figure 1:
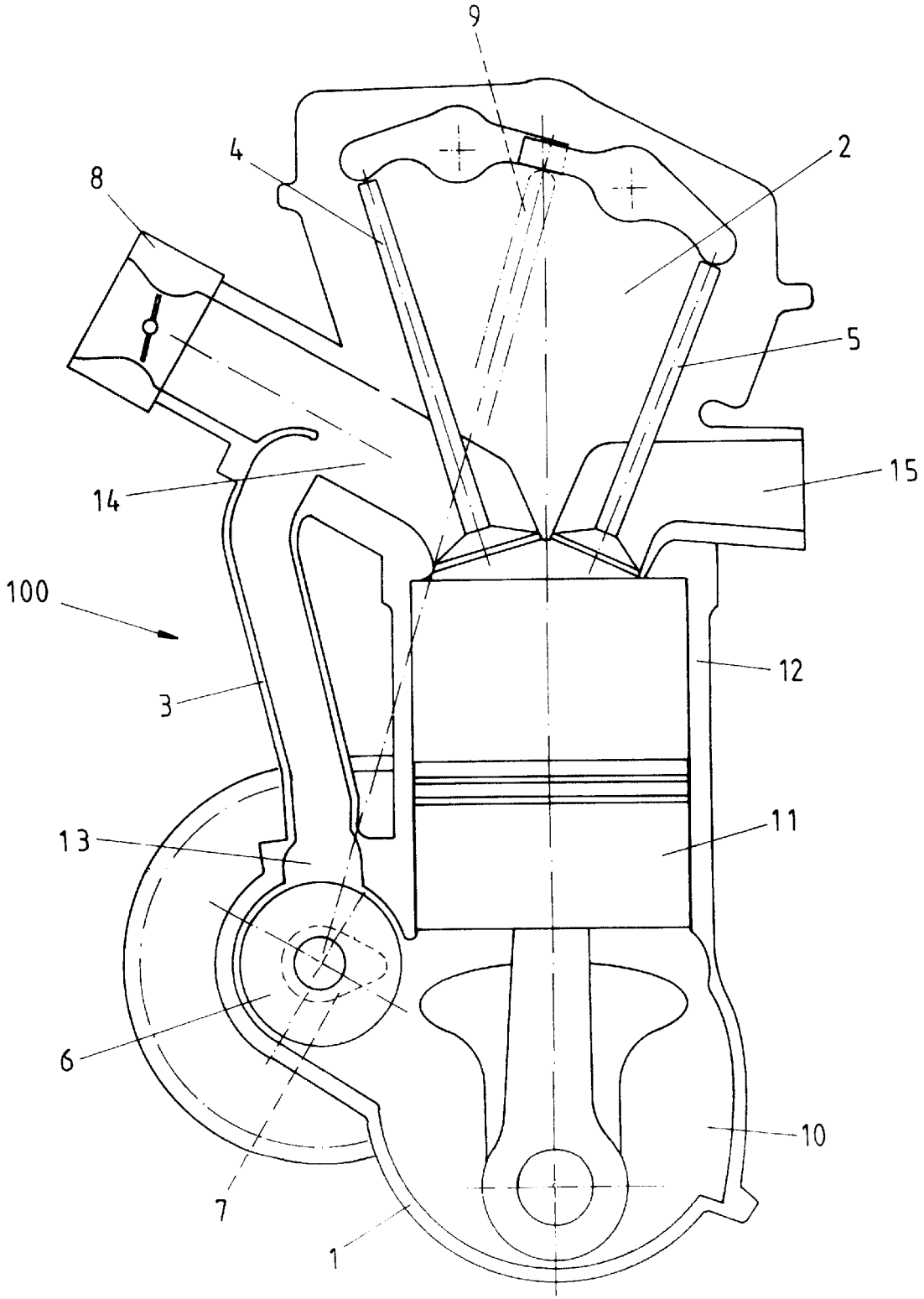
FIG. 1 shows a first preferred embodiment of the engine according to the invention with a carburetor directly connected with the intake port.

FIG. 1 shows in a simplified longitudinal section a four-cycle internal combustion engine 100 which has a cylinder 12 with an internal piston 11. The piston 11 is connected by a push rod with a crankshaft which rotates in a crank chamber 10, placed at the lower end of the cylinder 12, surrounded by a crankcase 1. The cylinder 12 is closed upwards by a cylinder head 2 which simultaneously constitutes the combustion space above the piston 11. The combustion space can also be in the piston 11, or it is divided into the cylinder head 2 and the piston 11. An intake port 14 for charging the combustion space with a mixture as well as an exhaust conduit 15 for blowing out the combustion gas are provided inside the cylinder head. An admission valve 4 is placed in the intake port 14 and an exhaust valve 5 is placed in the exhaust conduit 15. Both valves 4, 5 are controlled over connecting rods 9 by a lower placed camshaft 7.

A carburetor 8 in which the mixture formation takes place is connected at the intake port 14. Furthermore, an overflow duct 3 is connected between the carburetor 8 and the admission valve 4 at the intake port 14, this overflow duct leading downwards to the crankcase 1 and being connected there with the crank chamber 10 by an overflow opening 13. The tube which forms the overflow duct 3 can either be integrated into the crankcase 1, or it is designed as a separate tube—as shown in the figures. The overflow opening 13 can be opened and closed by means of a rotary disk valve 6. To this end, the rotary disk valve 6 is driven by the camshaft 7 or is directly integrated into the camshaft 7.

The rotary disk valve 6 controls the admission of the fuel-oil-air mixture from the carburetor 8 into the crank chamber 10 as well as the overflowing of the mixture from the crank chamber 10 into the cylinder head 2.

During the upward movement of the piston 11 for the discharge of the exhaust gas (exhaust phase of the engine), the rotary disk valve 6 makes possible the flowing in of the mixture from the carburetor 8 into the crank chamber 10 for a certain time. During the following downward movement of the piston 11 (intake phase of the engine), the mixture flows from the carburetor 8 through the opened admission valve 4 into the cylinder 12. The control periods of the rotary disk valve 6 are selected in such a way that either the overflow opening 13 is freed only just before the admission valve 4 is closed (recharging effect) or already before the admission valve 4 is opened in order to generate a charging movement before the admission valve is opened.

During the recharging, the mixture which is in the crankcase 1 is compressed by the downward movement of the piston 11, since the opening in the intake port 14 is closed by the rotary disk valve 6. Towards the end of the charging process, the rotary disk valve 6 frees the opening from the crankcase 1 to the intake port 14 and the compressed mixture flows through the opened admission valve 4 into the cylinder 12.

The lubrication of the driving elements, bearings and valves takes place with the circulating mixture charging. The mixture is eventually supplied over bypass valves directly to the friction pairings, or it comes into the cylinder head 2 over the push rod pits.

Figure 2:
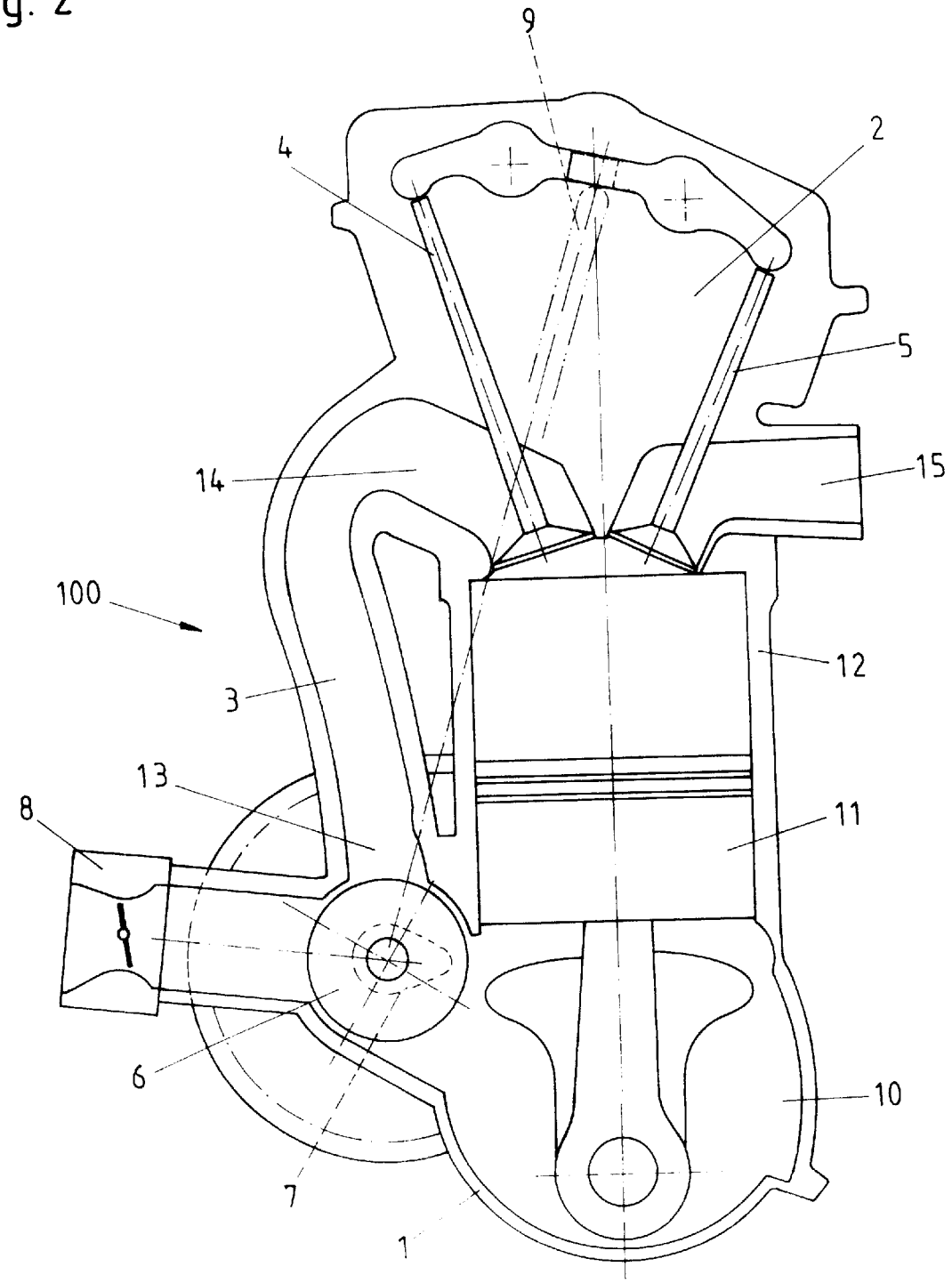
FIG. 2 shows a second preferred embodiment of the engine according to the invention with a carburetor connected in the area of the valve means (of the rotary disk valve).

As an alternative to the arrangement in FIG. 1, the carburetor 8 can also be fixed as represented in FIG. 2 (in FIG. 2, the same reference numerals as in FIG. 1 are used for the same elements). In the embodiment of FIG. 2, the carburetor 8 is lodged directly before the rotary disk valve 6 and thus supplies the mixture optionally over the overflow duct 3 into the intake port 14 or directly into the crank chamber 10. For the arrangement represented in FIG. 2, there are two operating possibities: either the rotary disk valve 6 controls the whole mixture flow, i.e. as well the flow from the carburetor 8 to the intake port 14 as the flow to and from the crank chamber 10 or the crankcase charging, or it only controls the crankcase charging, as it is the case for the embodiment of FIG. 1. Both modes of operation can be realized by a corresponding configuration of the rotary disk valve 6.

Globally, there results with the invention a four-cycle internal combustion engine with a mixture lubrication independent of the position which is constructed in a simple way and which is characterized by a good charging behaviour.

LIST OF REFERENCE NUMERALS

100 Four-cycle internal combustion engine
1 crankcase
2 cylinder head
3 overflow conduit
4 admission valve
5 exhaust valve
6 rotary disk valve
7 camshaft
8 carburetor
9 push rod
10 crank chamber
11 piston
12 cylinder
13 overflow opening
14 intake port
15 exhaust conduit

What is claimed is:

1. A compact four-cycle internal combustion engine (100) comprising a cylinder (12) which is closed on the top by a cylinder head (2) and which changes below into a crankcase (1) in the cylinder (12) a piston (11) moving up and down, in the cylinder head (2) an intake port (14) with an admission valve (4) and an exhaust conduit (15) with an exhaust valve (5), a carburetor (8) for forming an oil-fuel-air mixture lubricating the engine, as well as means (3, 6, 13) by which a mixture is transported within each engine cycle from the carburetor (8) into the crank chamber (10) closed by the crankcase (1) and from the crank chamber (10) into the intake port (14), characterized in that the carburetor (8) is connected outside the crank chamber (10) with the intake port (14).

2. An engine according to claim 1, characterized in that the carburetor (8) is directly connected with the intake port (14) and that the means comprise an overflow duct (3) which leads from the intake port (14) to an overflow opening (13) on the crankcase (1) and, controlled by valve means (6), connects the intake port (14) with the crank chamber (10).

3. An engine according to claim 1, characterized in that the means comprise an overflow duct (3) which leads from the intake port (14) to an overflow opening (13) on the crankcase (1) and, controlled by valve means (6), connects the intake port (14) with the crank chamber (10) and that the carburetor (8) is connected with the overflow duct (3) or the overflow opening (13) by the valve means (6).

4. An engine according to any of the claims 1 to 3, characterized in that the valve means comprise a rotary disk valve (6).

5. An engine according to claim 4, characterized in that the rotary disk valve (6) is placed in the crankcase (1) on the overflow opening (13) and periodically opens and closes this opening and that the rotary disk valve is driven by a camshaft which actuates the admission and exhaust valves (4 or 6) over push rods (9).

6. An engine according to claim 5, characterized in that the rotary disk valve (6) is integrated into the camshaft (7).

* * * * *